United States Patent [19]

Feldman

[11] 4,365,230

[45] Dec. 21, 1982

[54] LEAD SCREW TYPE VARIABLE RESISTOR

[75] Inventor: Steven Feldman, Seminole, Fla.

[73] Assignee: AMP Incorporated, Harrisburg, Pa.

[21] Appl. No.: 295,886

[22] Filed: Aug. 24, 1981

[51] Int. Cl.[3] ..... H01C 10/40

[52] U.S. Cl. ..... 338/180; 338/177; 338/183; 338/188

[58] Field of Search ..... 338/160, 176, 177, 180, 338/181, 123, 124, 183, 188

[56] References Cited

U.S. PATENT DOCUMENTS 3,742,421 6/1973 Van Rooijen ..... 338/180

FOREIGN PATENT DOCUMENTS 658067 3/1938 Fed. Rep. of Germany ..... 338/123

*Primary Examiner*—C. L. Albritton

*Attorney, Agent, or Firm*—F. Brice Faller

[57] ABSTRACT

Variable resistor comprises a lead screw 12 rotatably mounted to substrate 42 by conductive mounts 18, 18' and engaging a one-piece stamped and formed sheet metal slider 16 movable along circuit trace 20 in response to rotation of the screw 12. The lead screw 12 is a conductive plastic and thus acts as a resistance element, the resistance between the mounts 18, 18' and the circuit trace 20 being varied by rotating the screw 12. Mounts 18, 18' have spring-loaded arms 34, 36 which releasably retain the lead screw 12 so it may be replaced if it is desired to change the resistance limits of the device.

6 Claims, 5 Drawing Figures

LEAD SCREW TYPE VARIABLE RESISTOR

BACKGROUND OF THE INVENTION

This present invention relates to an improved lead screw type variable resistor which can be connected in a circuit to act as a rheostat or as a potentiometer.

The state of the art in lead screw type variable resistors is exemplified in U.S. Pat. Nos. 2,862,089; 3,124,779; 3,569,897; 3,631,372; 3,732,520; and 3,742,421. In these known variable resistors, five basic elements are required: a rotatably supported lead screw, a resistance element, a slider carried by said lead screw, a first circuit element electrically connected to one end of said lead screw, and a second circuit element electrically connected to said slider. More particularly, U.S. Pat. No. 3,742,421 discloses a potentiometer with a conductive lead screw rotatably carried by a pair of mounts, one of said mounts being connected to a first circuit element. The mounts are fixed to a substrate which carries a resistive element parallel to the lead screw. A conductive slider engages both the lead screw and the resistance element, the slider moving along the resistance element in response to rotation of the lead screw. A second circuit element is connected to one end of the resistance element, and the resistance between the two circuit elements may thus be varied by rotating the lead screw to vary the length of the electrical path through the resistance element. In the very competitive market for variable resistors and potentiometers of this configuration, it is desirable to reduce the number of parts to reduce unit cost.

SUMMARY OF THE INVENTION

In pursuit of reduced costs, the present invention combines several of the above required components into single elements.

According to one aspect of the present invention, therefore, a lead screw type variable resistor is characterized in that the resistance element is integral with the lead screw. Not only does this combination of resistance element and lead screw into a single element reduce the number of components required, but it also provides the variable resistor assembly with increased flexibility. By merely removing the lead screw from the assembly and inserting another, the resistance limits of the variable resistor assembly can be altered.

According to another aspect of the invention, a variable resistor as defined in the second paragraph of this specification is characterized in that the slider is stamped and formed sheet metal.

By fabricating the slider from a conductive material, a portion of same is the resistance element contact. The variable resistor assembly is thus further simplified and fabrication costs are reduced.

BRIEF DESCRIPTION OF THE DRAWINGS

For a better understanding of the invention, reference will now be made by way of example to the accompanying drawings, in which.

DETAILED DESCRIPTION OF THE PREFERRED EMBODIMENT

Figure 1:
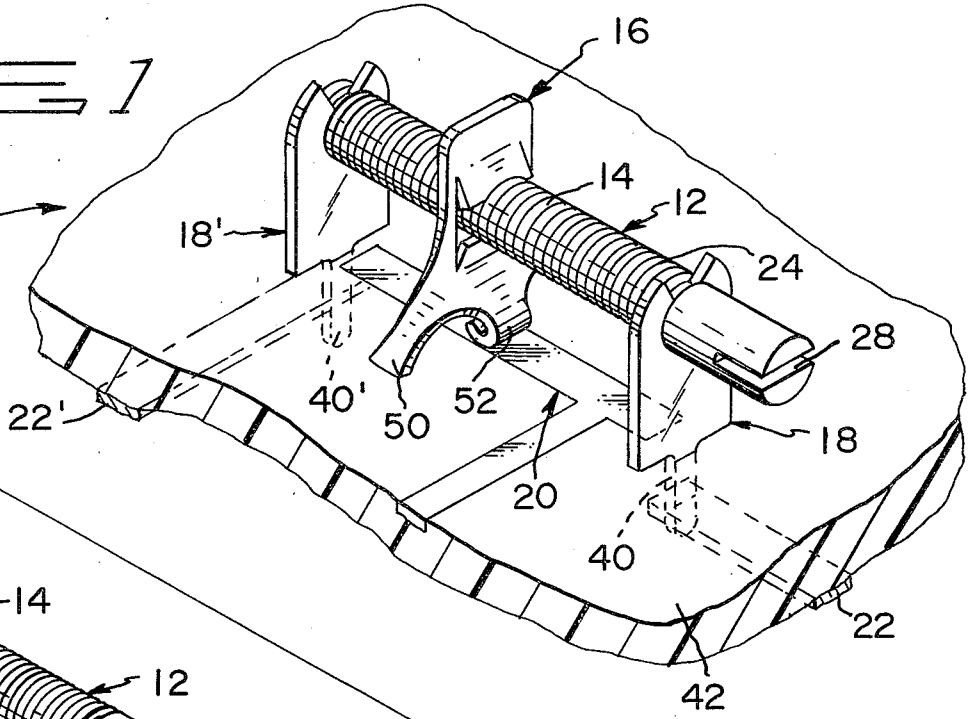
FIG. 1 is a perspective view of a lead screw type variable resistor in accordance with the present invention shown mounted on an insulating substrate.

FIG. 1 shows a lead screw type variable resistor 10, in accordance with the present invention, having a lead screw 12, a resistance element 14 incorporated into the lead screw 12, a slider 16 movable along the resistance element 14 by rotation of the lead screw 12, spring-loaded mounts 18, 18' electrically contacting the resistance element 14 at each end thereof and rotatably supporting the lead screw 12, and a trace 20 providing electrical connection to the slider 16.

Figure 4:
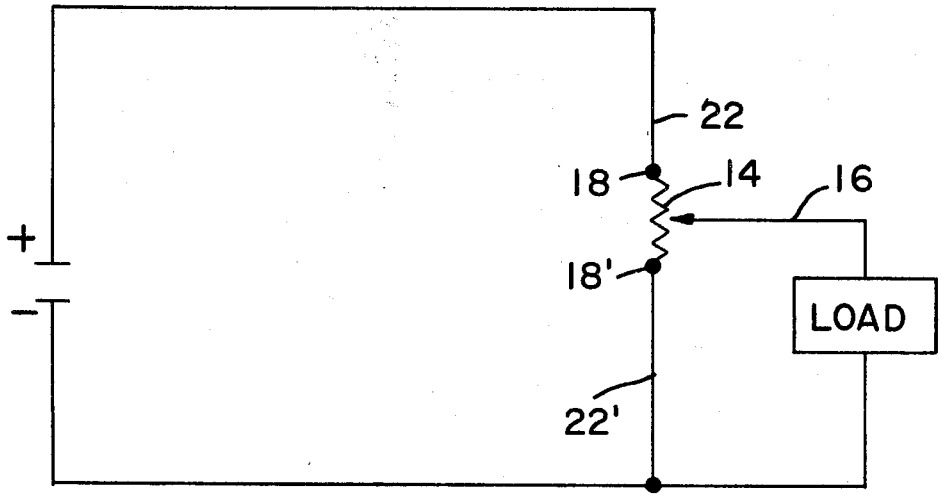
FIG. 4 is a schematic showing a variable resistor connected to a circuit as a potentiometer.
Figure 5:
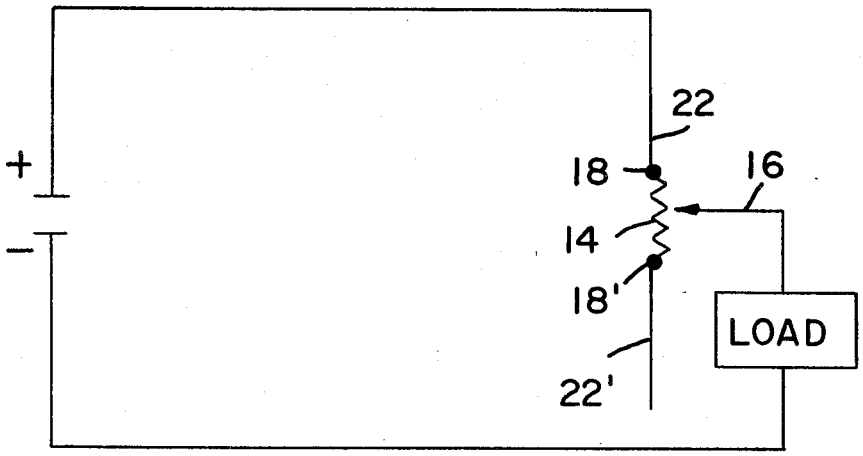
FIG. 5 is a schematic showing a variable resistor connected to a circuit as a rheostat.

As shown in FIGS. 4 and 5, the variable resistor 10 can be used as a rheostat or as a potentiometer. When both mounts or terminals 18, 18' are connected into a circuit by conductors 22, 22', respectively, the variable resistor 10 acts as a potentiometer (FIGS. 1 and 4). If, however, conductor 22' does not connect terminal 18' into the circuit, the variable resistor 10 acts as a rheostat (FIG. 5).

Figure 2:
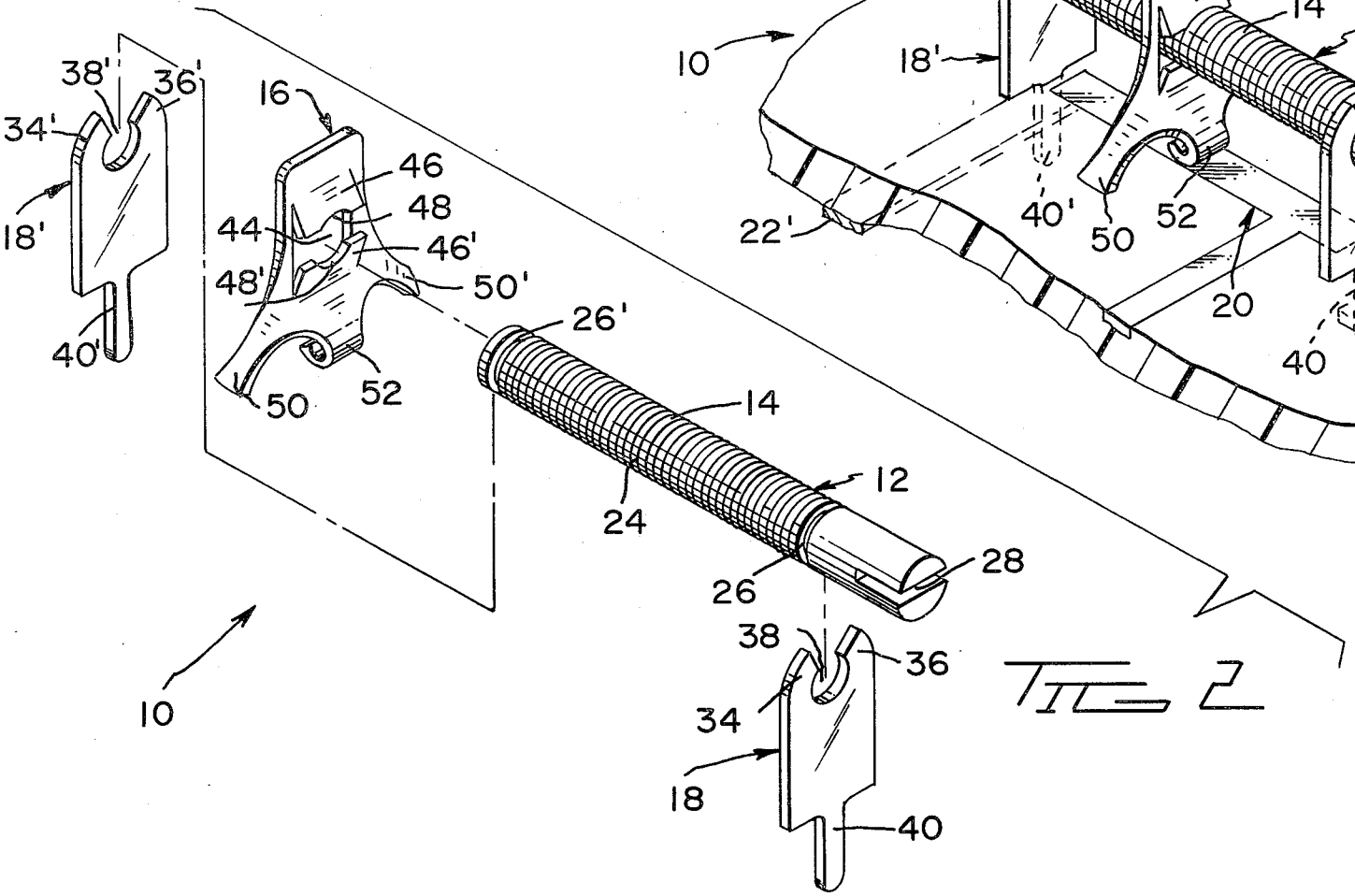
FIG. 2 is an exploded perspective view of a lead screw type variable resistor in accordance with the present invention.

The lead screw 12 as shown in FIG. 2 is molded from a conductive plastic. The entire lead screw 12, therefore, comprises the resistance element 14. The lead screw 12 has a transport thread 24, mounting grooves 26, 26' adapted to electrically and mechanically engage the spring-loaded mounts 18, 18', and tool accepting means in the form of a slot 28 at one end of the lead screw 12 permitting insertion of a screwdriver to rotate the lead screw 12.

Figure 3:
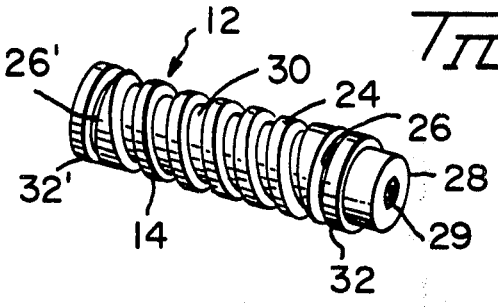
FIG. 3 is a perspective view of an alternative embodiment of the lead screw.

An alternative embodiment of the lead screw 12 is shown in FIG. 3, in which the lead screw 12 comprises a central shaft 30 of non-conductive plastic. Molded onto this shaft 30 is a conductive plastic transport thread 24, forming the resistance element 14, and conductive plastic journals 32, 32' at each end of the resistance element 14 which are continuous with the thread 24. Mounting grooves 26, 26' on the journals 32, 32' electrically and mechanically engage the spring-loaded mounts 18, 18'. Tool accepting means in the form of a hexagonal bore 29 at one end of the non-conductive shaft 30 permits insertion of a hex key to rotate the lead screw 12. This alternative tool accepting means permits forming same by extruding the shaft 30 without further machining, as would be required with a screwdriver slot.

The spring-loaded mounts 18, 18' as shown in FIG. 2 each have a pair of resilient, spaced-apart arms 34, 36; 34', 36' forming screw retaining slots 38, 38' adapted to rotatably engage the mounting grooves 26, 26' and provide electrical contact therewith. The resiliency of the arms 34, 36, 34', 36' permits the lead screw 12 to be readily inserted into or removed from the screw retaining slots 38, 38'. Mounting tails 40, 40' can be inserted into a dielectric substrate 42, as shown in FIG. 1, or into a wall of an insulating package that houses the variable resistor assembly 10 (not shown).

The slider 16 is stamped and formed from sheet metal. As shown in FIG. 2, the slider 16 has a nut portion 44 formed by a pair of opposed lances 46, 46' each having a resistance element contact surface 48, 48' that engages the transport thread 24. Stabilizers 50, 50' bear on the substrate 42 to prevent rotation of the slider 16 about the axis of the lead screw 12. A resilient wiper 52 wipingly contacts the trace 20, which is disposed in parallel to the lead screw 12 and mounted in the substrate 42.

By inserting a screwdriver in the slot 28, the lead screw 12 may be rotated, thereby transporting the slider 16 along the resistance element 14 and varying the resistance. During slider's 16 travel, constant electrical connection is maintained through the wiper 52 and trace 20. The alternative embodiment of FIG. 3 functions somewhat differently insofar as the transport thread 24 constitutes the resistance element 14 which thus has a much longer electrical path. A full turn of the screw will vary the length of the path by a circumference rather than the distance between threads, so finer tuning is also possible. Note that in either embodiment the resistance element 14 may be exchanged for another if a different range of resistances is desired.

The above described embodiments are exemplary and not intended to limit the scope of the claims which follow.

I claim:

1. A variable resistor comprising:

a lead screw with an integral resistance element;

a pair of mounts which rotatably carry said lead screw, said mounts being fixed to a substrate, at least one said mount providing electrical connection between said resistance element and a first circuit element;

a slider operatively engaging said lead screw and movable in response to rotation of said screw, said slider being in contact with said resistance element;

a second circuit element in said substrate which said slider moves along in response to rotation of said lead screw, said slider remaining in electrical contact with said second circuit element, whereby, rotation of said lead screw will cause said slider to move along said resistance element, thereby varying the resistance between the first circuit element and the second circuit element.

2. A variable resistor according to claim 1, characterized in that said lead screw is a conductive plastic member.

3. A variable resistor according to claim 1, characterized in that at least one of said mounts comprises a pair of resilient, spaced-apart arms profiled to releasably retain said lead screw therebetween.

4. A variable resistor according to claim 1, characterized in that said lead screw comprises a molded nonconductive plastic shaft with a conductive plastic transport thread molded thereon.

5. A variable resistor according to claim 4, characterized in that said lead screw has at least one conductive plastic journal molded thereon at at least one end of said thread, said journal being continuous with said thread, said journal being carried by said mount providing electrical connection between said resistance element and said first circuit element.

6. A variable resistor according to claim 1, characterized in that said slider is stamped and formed from sheet metal and further comprises:

nut means cooperating with said lead screw and electrically contacting said resistance element; and stabilizer means bearing on said substrate to prevent said slider from rotating about the axis of said lead screw.

* * * * *